US006089970A

United States Patent [19]

Feustel

[11] Patent Number: 6,089,970

[45] Date of Patent: Jul. 18, 2000

[54] ENERGY EFFICIENT LABORATORY FUME HOOD

[75] Inventor: Helmut E. Feustel, Albany, Calif.

[73] Assignee: The Regents of the University of California, Oakland, Calif.

[21] Appl. No.: 09/056,761

[22] Filed: Apr. 7, 1998

Related U.S. Application Data

[60] Provisional application No. 60/066,650, Nov. 24, 1997.

[51] Int. Cl.[7] ..... B08B 15/02

[52] U.S. Cl. ..... 454/57

[58] Field of Search ..... 454/56, 57, 61, 454/62

[56] References Cited

U.S. PATENT DOCUMENTS

| | | | |
|---|---|---|---|
| 2,649,727 | 8/1953 | Snow et al. | 454/57 |
| 3,021,776 | 2/1962 | Kennedy | 454/57 |
| 3,496,857 | 2/1970 | Ellis et al. | 454/57 |
| 4,475,534 | 10/1984 | Moriarty | 454/56 X |
| 4,550,650 | 11/1985 | Denner et al. | 454/57 |
| 4,553,475 | 11/1985 | Saunders | 454/57 |
| 4,590,847 | 5/1986 | Hull | 454/57 |
| 5,113,749 | 5/1992 | Perbix | 454/57 |
| 5,167,572 | 12/1992 | Etkin . | |

FOREIGN PATENT DOCUMENTS

| | | | |
|---|---|---|---|
| 1009495 | 5/1977 | Canada | 454/57 |
| 1126566 | 6/1982 | Canada | 454/57 |

OTHER PUBLICATIONS

Daisy, Joan M., "Low–Flow Fume Hood", *Indoor Environment Program 1995 Annual Report*, pp. 10–11, (published Apr. 8, 199).

Monsen, R.R., "Practical Solutions to Retrofitting Existing Fume Hoods and Laboratories", *ASHRAE Transactions*, pp. 845–851 (1987).

Maust, et al., "Laboratory Fume Hood Systems, Their use and Energy Conservation", *ASHRAE Transactions*, pp. 1813–1821 (1987).

*Primary Examiner*—Harold Joyce
*Attorney, Agent, or Firm*—Beyer Weaver & Thomas, LLP

[57] ABSTRACT

The present invention provides a low energy consumption fume hood that provides an adequate level of safety while reducing the amount of air exhausted from the hood. A low-flow fume hood in accordance with the present invention works on the principal of providing an air supply, preferably with low turbulence intensity, in the face of the hood. The air flow supplied displaces the volume currently present in the hood's face without significant mixing between the two volumes and with minimum injection of air from either side of the flow. This air flow provides a protective layer of clean air between the contaminated low-flow fume hood work chamber and the laboratory room. Because this protective layer of air will be free of contaminants, even temporary mixing between the air in the face of the fume hood and room air, which may result from short term pressure fluctuations or turbulence in the laboratory, will keep contaminants contained within the hood. Protection of the face of the hood by an air flow with low turbulence intensity in accordance with a preferred embodiment of the present invention largely reduces the need to exhaust large amounts of air from the hood. It has been shown that exhaust air flow reductions of up to 75% are possible without a decrease in the hood's containment performance.

34 Claims, 6 Drawing Sheets

ENERGY EFFICIENT LABORATORY FUME HOOD

CROSS-REFERENCE TO RELATED APPLICATIONS

This application claims the benefit of the filing date of U.S. Provisional Patent Application Ser. No. 60/066,650 (Attorney Docket No. IB-1205P) entitled ENERGY EFFICIENT LABORATORY FUME HOOD filed Nov. 24, 1997, the disclosure of which is incorporated by reference herein for all purposes.

BACKGROUND OF THE INVENTION

This invention was made with government support under Grant (Contract) No. DE-AC03-76SF00098 awarded by The U.S. Department of Energy. The government has certain rights to this invention.

This invention relates generally to fume hoods, and in particular to energy-efficient laboratory fume hoods. More specifically, the invention relates to laboratory fume hoods having air supplied through sources at the hood's face.

A fume hood may be generally described as a ventilated enclosed workspace intended to capture, contain, and exhaust fumes, vapors, and particulate matter generated inside the enclosure. The purpose of a fume hood is to draw fumes and other airborne matter generated within a work chamber away from a worker, so that inhalation of contaminants is minimized. The concentration of contaminants to which a worker is exposed should be kept as low as possible and should never exceed a safety threshold limit value. Such safety thresholds and other factors relating to testing and performance of laboratory fume hoods are prescribed by government and industry standards by organizations, such as the American Society of Heating, Refrigerating and Air-Conditioning Engineers, Inc. (ASHRAE) of Atlanta, Ga., for example, ANSI/ASHRAE 110–1995. ASHRAE Standard, "Method of Testing Performance of Laboratory Fume Hoods." This and all other documents cited in this application are incorporated herein by reference for all purposes.

FIG. 1 shows a cross-sectional side view of a conventional fume hood. The hood 100 includes a work chamber 102, bounded by walls 103 and a front open face 105 which may be covered partially or completely by a moveable sash 114. The hood may be supported by a base 104. In many designs, the base contains cabinets for storage of solvents and other materials used in the hood's work chamber 102.

While hood sizes vary considerably, a typical conventional fume hood is about 4 to 8 feet wide with a sash opening of between about 26 and 31 inches, and a standard interior vertical size of about 48 inches. The hood's walls 103 typically have considerable width because they provide an aerodynamically shaped entrance to the work chamber 102 and contain mechanical and electrical services for the hood. Again, while dimensions of fume hoods greatly vary, the depth of a typical fume hood ranges from about 32 to about 37 inches. A typical conventional hood design includes an air foil 106 at the bottom front of the work chamber 102 and a baffle 108 at the rear of the work chamber 102. The depth of the work chamber 102 between these two features 106 and 108 is typically approximately 21 inches.

The air foil 106 at the entrance to the work chamber 102 is an important aerodynamic design feature of the fume hood 100. The air foil 106 is designed to prevent the formation of turbulent air flow in the lower part of the hood's work chamber 102. In a conventional design, the air foil 106 runs at an upward angle from the front plane of the fume hood 110 towards the rear of the fume hood 112.

The opening in the front of the fume hood 100 which provides access to the work chamber 102 by a worker, is referred to as the face of the fume hood. In some conventional fume hood designs, referred to as open-faced hoods, the face area of the hood is fixed. In other designs, such as that depicted in FIG. 1, a moveable sash 114 provides the ability to alter the face area of the hood 100. Sashes come in either vertical or horizontal arrangements, with the vertical design typically being preferred since it can provide a full open face area.

Other elements of conventional fume hoods illustrated in FIG. 1 include an air bypass area 116 above the sash in the top front of the fume hood 100 which provides an additional path for ambient air to enter the work chamber 102. The bypass 116 provides sufficient air flow to dilute contaminants in the hood, and to avoid air whistling when the sash 114 is closed. Air is exhausted from the fume hood through an exhaust system equipped with a fan (not shown) which draws air into the fume hood's work chamber 102, through the baffle 108, and into ducting 118 outside the work chamber 102 of the fume hood 100 for exhaustion from the building. The top wall of the fume hood is also typically equipped with a light fixture 120 to illuminate the work chamber 102. The back baffle 108 typically includes two or three horizontally disposed slots to direct air flow within the work chamber 102. Further details regarding the design and construction of conventional laboratory fume hoods may be found in Sanders G. T., 1993. Laboratory Fume Hoods, A User's Manual. John Wiley & Sons, Inc.

Containment of contaminants in a conventional fume hood is based on the principal of a directed (inward) air flow in the face of the hood. As noted above, the face corresponds to the area below the sash (in the case of a vertical sash arrangement) at the front of the hood through which air enters the work chamber. In a conventional fume hood design, the lower boundary of the face is defined by an air foil, as discussed above.

For safe fume hood operation, the laboratory in which the fume hood is located should be well-ventilated. For typical laboratory operations, six air changes per hour (acph) of outside air are recommended for a safe B-2 occupancy laboratory. Bell, et al., 1996. A design for Energy Efficient Research Laboratories. Lawrence Berkeley National Laboratory Publication No. 777. For laboratories that routinely use hazardous materials, such as carcinogens, ten to twelve outside acph are often recommended.

An important factor in a conventional fume hood's ability to contain contaminants is its face velocity. The face velocity of a fume hood is determined by its exhaust and its open face area. Recommendations for face velocity of conventional fume hoods range from 75 feet per minute (fpm) for materials of low toxicity (Class C: TLV>500 ppm) to 130 fpm for extremely toxic or hazardous materials (Class A: TLV<10 ppm). Cooper, E. C., 1994. *Laboratory Design Handbook*, CRC Press. In general, industrial hygienists recommend face velocities of 100 fpm for containment of contaminants by conventional hoods with open sashes.

In addition to the hood design, the position of the worker with respect to the air flow direction may have a significant influence on the air flow patterns in the hood, and particularly in the face of the hood. Air flows surrounding a body standing in front of the hood create a region of low pressure downstream of the body. This region, which is deficient in momentum, is called the wake. It disturbs the directed air flow in the face of the hood causing turbulence which may result in reversal of flow causing contaminants to spill from the hood's work chamber into the surrounding laboratory space.

It has also been found that hood leakage is dependent on laboratory air flow patterns. National Institute of Health, 1997. *Methodology for Optimization of Laboratory Hood Containment*. Volumes 1 and 2. The turbulent fluctuation in air velocity generated in the room surrounding the hood face is carried into the hood by the general flow of air. Therefore, a hood's performance may be affected by the hood's location with respect to doors, supply air outlets and areas with foot traffic.

FIG. 2 shows a cross-sectional side view of a conventional fume hood design, such as that illustrated in FIG. 1, further illustrating ideal air flow through such a conventional hood. Air is shown entering the hood 200 from the surrounding laboratory space 201 by arrows 202. The air flows through the open face 203 of the hood 200 defined by the fully open sash 206 and the air foil 208 into the work chamber 205. Inside the work chamber 205 the air is drawn towards slots 204 in the baffle 207 at the rear of the work chamber 205. In the particular design depicted in FIG. 2, the air flow generated by the slots establishes a vortex 210 in the upper region of the work chamber. If this vortex extends to or below the upper limit of the open face 203, the risk of spillage of airborne contaminants from the hood 200 is increased. Having passed through the baffle 207, the air is then exhausted through the exhaust system 212.

As described above, the air source for conventional fume hoods is the ambient air in a laboratory in which the fume hood is located. The additional air which must be provided to a laboratory space by a building's HVAC system to replace air exhausted by a fume hood is referred to as "make-up air." Since make-up air is supplied as part of the laboratory's ambient air, it must be conditioned to the same degree if comfort and safety levels in the laboratory are to be maintained. As a result, laboratory buildings have very high energy intensities. Conditioning of the make-up air to be exhausted by fume hoods uses most of the energy beyond what is required for technical apparatus and lighting in laboratory environments. The high energy consumption caused by fume hood exhaust air flows is a result of both the need to condition make-up air and in conventional systems and to move it through a building's air flow handling system. Thus, the operation of conventional laboratory fume hoods results in a tremendous energy wastage.

Several attempts have been made to reduce the energy consumption of laboratory fume hoods. In order to maintain an appropriate level of safety, it is not practical to reduce the volume of air exhausted by a conventional fume hood. As noted above, in order to maintain an appropriate safety margin face velocities should be maintained at approximately 100 fpm. Two alternate fume hood designs developed to provide energy savings over conventional fume hood designs are discussed below. The descriptions of these alternate designs use terms described with reference to FIG. 1, and reference to that figure may assist in an understanding of these designs.

A first attempt to save conditioning energy is the auxiliary air fume hood. Auxiliary air fume hoods supply unconditioned (or less-conditioned) air near the top and front of the hood sash outside the front plane of the hood. Therefore, the amount of conditioned room air drawn into and exhausted by the hood is reduced. However, the un/less-conditioned air, which may be up to 95% of the exhaust, often causes thermal discomfort in winter when outside air is cold or in summer when outdoor humidity and temperature levels are high. Auxiliary air can also adversely impact experiments, since the air temperature in the hood's work chamber will not be the same as the ambient laboratory room air temperature. In addition to these problems related to the thermal condition of auxiliary air, the system presents some engineering challenges in providing an air supply of an appropriate volume and velocity to the face area of the hood. Further, while auxiliary air fume hoods reduce the amount of energy used to condition make-up air, and reduce infrastructure costs by permitting installation of downsized heating and cooling equipment, they do not reduce fan energy consumption because they do not change the amount of air exhausted from the hood.

Another alternative fume hood design, referred to as a variable air volume (VAV) hood makes use of the energy saving strategy of controlling the amount of air flow through the hood as a function of the hood's sash location. Conventional constant-volume fume hoods are not constant face-velocity hoods, since the exhaust air fan removes approximately the same amount of air regardless of the sash position. In a vertical sash implementation, if the sash is lowered, the face velocity increases and may reach unsafe levels. For example, it has been found that face velocities higher than 125 fpm can create significant turbulence inside the hood, causing the fumes to spill into the laboratory. Monsen, R. R., 1987. Practical Solutions to Retrofitting Existing Fume Hoods and Laboratories. ASHRAE Transactions. 845–51.

VAV fume hoods are constant face-velocity fume hoods. They are equipped with a variable air volume exhaust fan and automatic controls. Fume hoods equipped with VAV regulate the amount of exhaust from the hood to obtain a relatively constant face velocity. The exhaust air flow can be controlled by sensing the face velocity, the sash position, or the pressure between the inside of the hood and the room outside the hood. VAV systems also control the amount of make-up air by means of multiple dampers. An example of a VAV fume hood system is described by Maust, et al., 1987. Laboratory Fume Hood Systems, their use and Energy Conservation. ASHRAE Transactions. 1813–19.

VAV fume hoods are theoretically safer than conventional hoods, because the face velocity stays constant independent of the sash position. In addition, if the sash is less than fully open for a significant period of time, a VAV system may result in significant energy savings. However, user discipline, or automatic controls to determine whether a person is present at the hood, are necessary for the VAV system to save energy. A further disadvantage of the VAV system is the relative complexity of the automatic systems which must be in place for such a system to function.

Accordingly, alternative low energy consumption fume hood designs would be desirable.

SUMMARY OF THE INVENTION

To achieve the foregoing, the present invention provides a low energy consumption fume hood that provides an adequate level of safety while reducing the amount of air exhausted from the hood. A low-flow fume hood in accordance with the present invention works on the principal of providing an air supply, preferably with low turbulence intensity, in the face of the hood. The air flow supplied displaces the volume currently present in the hood's face without significant mixing between the two volumes and with minimum injection of air from either side of the flow.

This air flow provides a protective layer of clean air between the contaminated low-flow fume hood work chamber and the laboratory room. Because this protective layer of air will be free of contaminants, even temporary mixing between the air in the face of the fume hood and room air, which may result from short term pressure fluctuations or turbulence in the laboratory, will keep contaminants contained within the hood. Protection of the face of the hood by an air flow with low turbulence intensity in accordance with a preferred embodiment of the present invention largely reduces the need to exhaust large amounts of air from the hood. It has been shown that exhaust air flow reductions of up to 75% are possible without a decrease in the hood's containment performance.

In one aspect, the invention provides a fume hood having a partially enclosed work chamber with a front open face. One or more supply air sources are provided at the face of the work chamber, and at least one air exhaust outlet is provided from the work chamber. Air emitted through the supply air sources to the face provides a protective layer of air between air on either side of the face. Preferably, the air emitted through the supply air sources to the face has a low turbulence intensity.

In another aspect, the invention provides a method of preventing airborne contaminants from escaping through the face of a fume hood. The method involves supplying an air flow to the face of the hood to produce a protective layer of air between air on either side of the face. Preferably, the air supplied to the face has a low turbulence intensity.

These and other features and advantages of the present invention are described below with reference to the drawings.

BRIEF DESCRIPTION OF THE DRAWINGS

FIG. 6 shows Table 1 which summarizes the test plan and results described in Example 2.

DETAILED DESCRIPTION OF THE PREFERRED EMBODIMENTS

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known process operations have not been described in detail in order not to unnecessarily obscure the present invention.

The present invention provides a low energy consumption fume hood that provides an adequate level of safety while reducing the air flowing through the hood. Like the auxiliary air fume hood described above, the low-fume hood designed of the present invention also uses an air supply that is placed between the person working in front of the hood and the work chamber. However, while the performance of a conventional fume hood (including the auxiliary air fume hood) depends on an air supply that forces air through the face of the hood, a low-flow fume hood in accordance with the present invention works on the principal of an air supply, preferably with low turbulence intensity, in the face of the hood. The air flow supplied displaces the volume currently present in the hood's face without significant mixing between the two volumes and with minimum injection of air from either side of the flow. This air flow provides a protective layer of clean air between the contaminated low-flow fume hood work chamber and the laboratory room. Because this protective layer of air will be free of contaminants, even temporary mixing between the air in the face of the fume hood and room air, which may result from short term pressure fluctuations or turbulence in the laboratory, will keep contaminants contained within the hood. Protection of the face of the hood by an air flow with low turbulence intensity in accordance with a preferred embodiment of the present invention largely reduces the need to exhaust large amounts of air from the hood. It has been shown that exhaust air flow reductions of up to 75% are possible without a decrease in the hood's containment performance.

Figure 1:
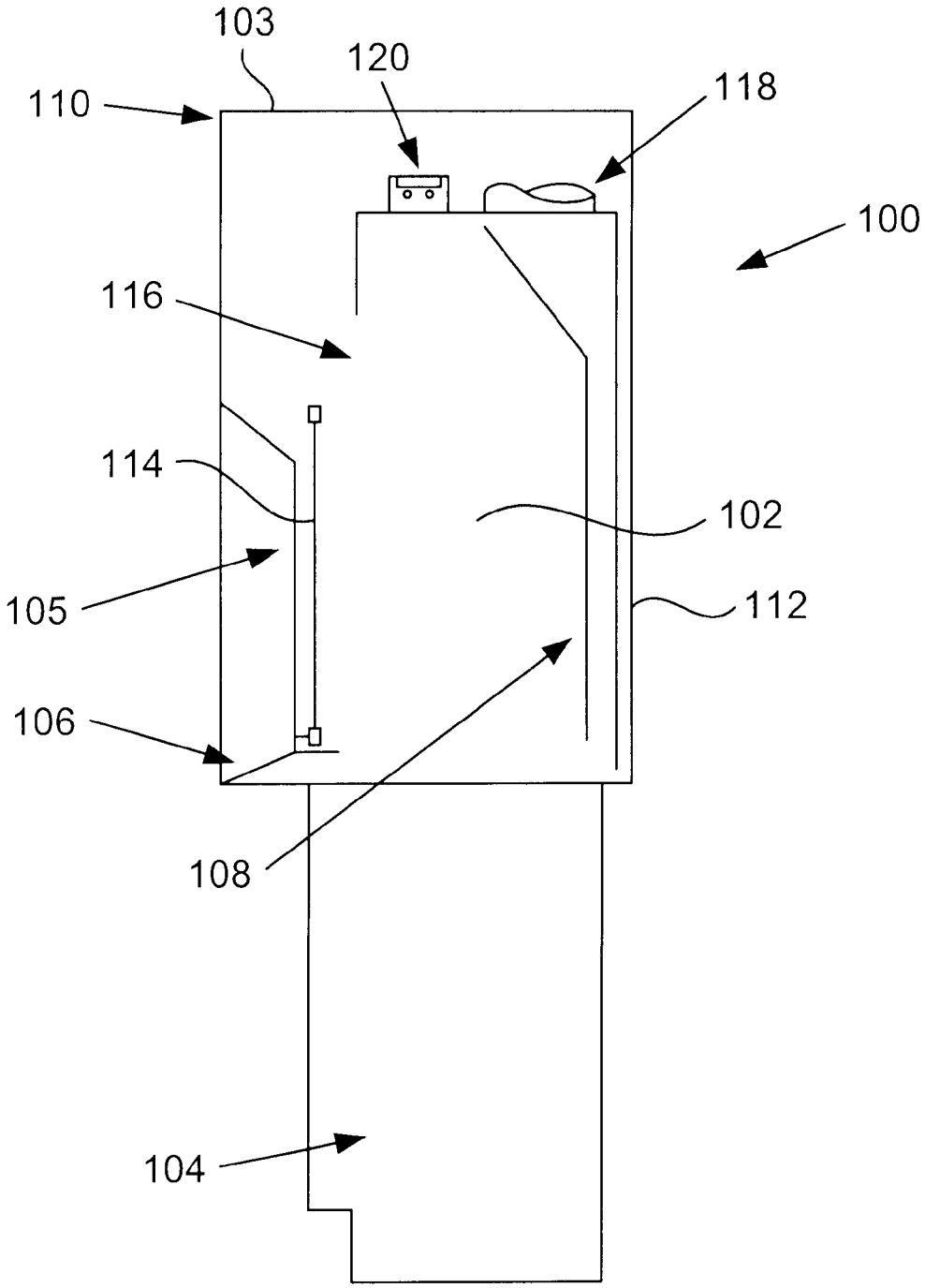
FIG. 1 (Prior Art)
FIG. 1 is a cross-sectional side view of a conventional laboratory fume hood.
Figure 2:
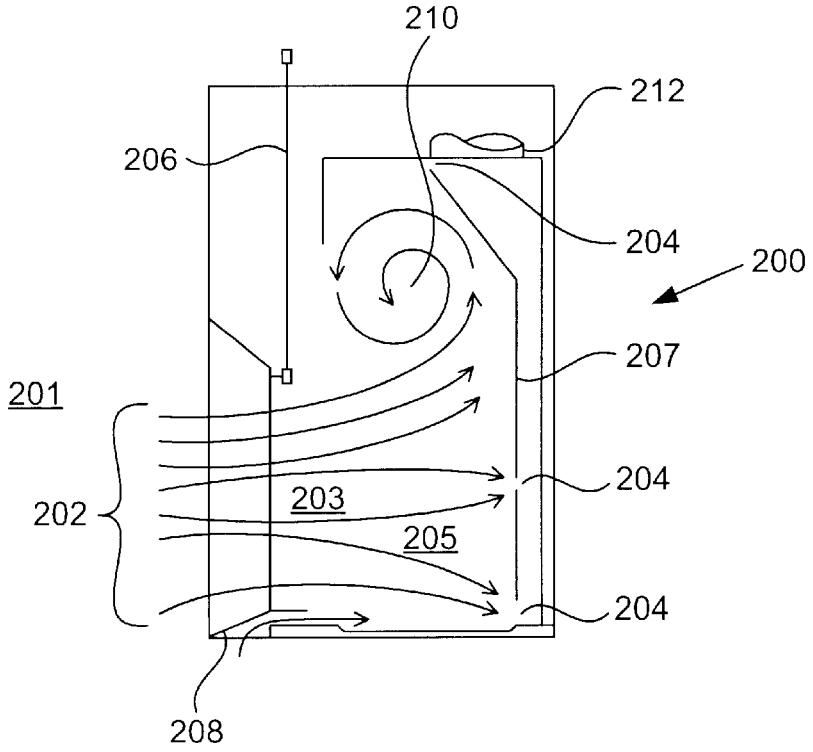
FIG. 2 (Prior Art)
FIG. 2 is a cross-sectional side view showing air flow in a conventional laboratory fume hood.
Figure 3A:
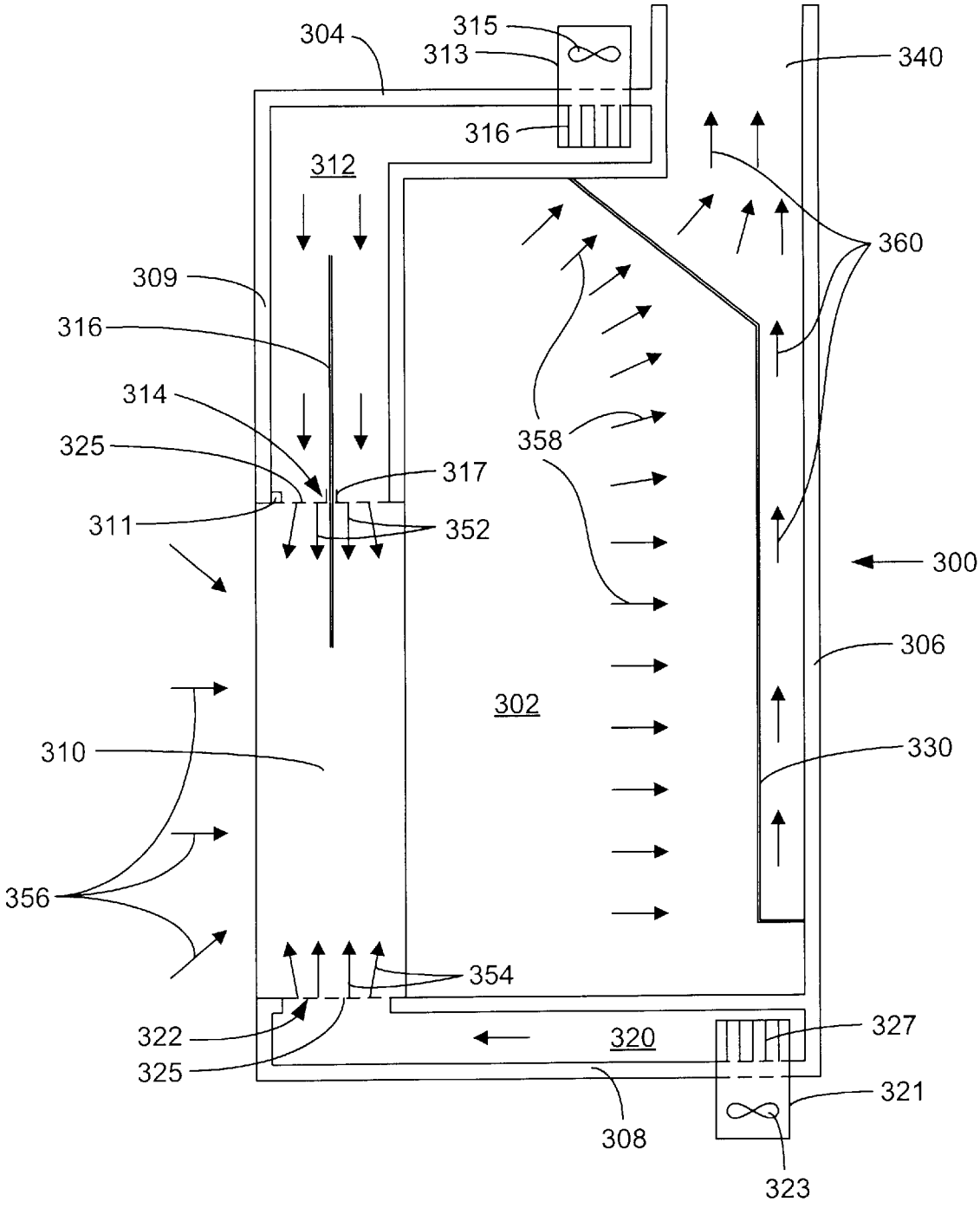
FIG. 3A is a cross-sectional side view of a low-flow fume hood, in accordance with the preferred embodiment of the present invention.
Figure 3B:
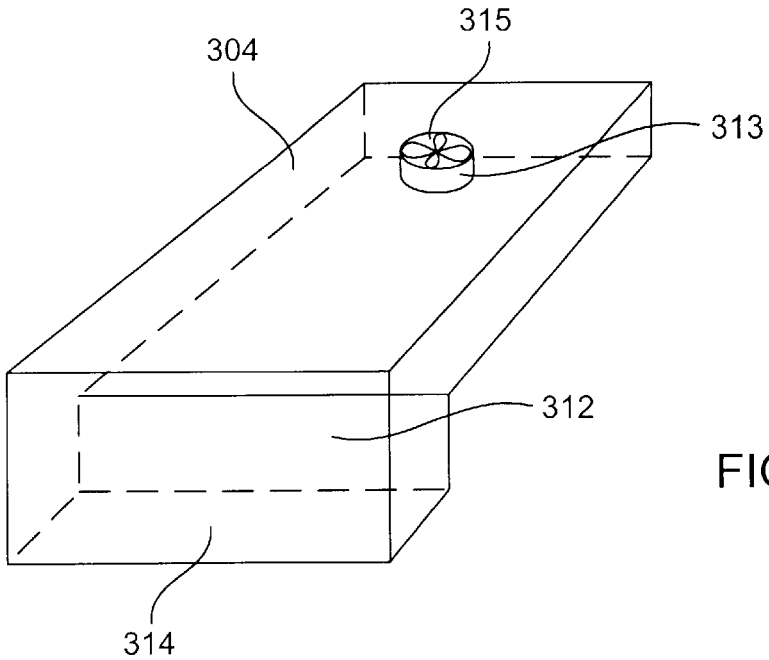
FIG. 3B depicts a perspective view of the top air plenum of FIG. 3A, in accordance with the preferred embodiment of the present invention.
Figure 3C:
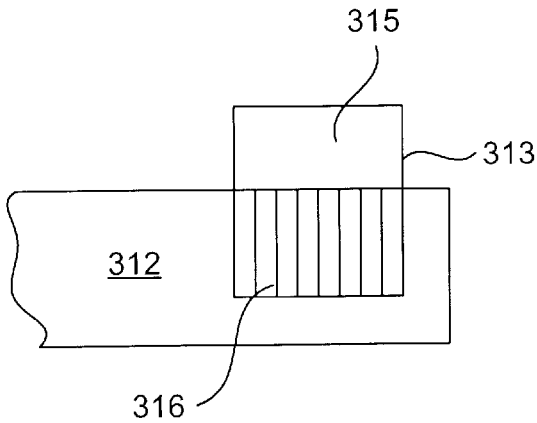
FIG. 3C depicts a cross-sectional side view of the rear portion of the top air plenum of FIG. 3A, showing the fan, in accordance with the preferred embodiment of the present invention.

A preferred embodiment of a low-flow laboratory fume hood in accordance with the present invention is illustrated in FIGS. 3A–C. While it is believed that the primary application of the fume hood of the present invention will be in research and industrial laboratories, it should be understood that the invention is applicable to any situation where containment of airborne contaminants is an issue (e.g., spray booths). As shown in FIG. 3A, the fume hood 300 includes many elements of conventional fume hoods, with adaptations made for low-flow operation. In this preferred implementation of the present invention, the fume hood 300 includes a work chamber 302 defined by side enclosure panels (not shown in this cross-sectional view), a top enclosure panel 304, a back enclosure panel 306, a bottom work area panel 308, a front partial enclosure panel 309, and a front open face 310.

The top 304 and front 309 enclosure panels enclose a supply air plenum 312, also illustrated in perspective in isolation in FIG. 3B. The supply air plenum 312 preferably draws air from the room in which the hood is located through a supply air inlet 313 equipped with a fan 315, and supplies it to a supply air outlet 314 at the lower end 311 of the front enclosure panel 309. To obtain even velocity of the supply air over the whole width of the supply air outlet 314, the supply air fan 315 sits on top of the supply air plenum 312, as shown in the isolated perspective view of FIG. 3C, pressing the air through an air flow straightener 316 into the plenum 312. The air flow straightener 316 breaks the rotating motion of the air leaving the fan 315. The impact of the air hitting the floor of the air plenum 312 helps to evenly distribute the air over the whole width of the plenum. It should be noted that in alternative embodiments of the present invention, the fan arrangement may be replaced by, for example, a duct either connected to the supply air system, an auxiliary air system, or attached to a fan providing room air as described above. The partial front enclosure panel 309 also provides a housing for a moveable vertical sash 316 when it is in a retracted position.

An important factor in providing an air flow protection zone at the face of a hood is to have about the same supply air velocity over the width of the supply air outlet. If this is not the case, there may be areas of lower containment across the face. In the preferred embodiment depicted in FIG. 3A, the air is provided to the supply air outlets 314 and 322 from the external side at the rear end of the air supply plenums 312 and 320. To help to eventually distribute the air, the flow straighteners 316 and 327 reach into the plenums to leave only approximately ¾ of an inch space between the flow straightener and the far side of the plenum. The momentum of the flow hitting the far side of the plenum helps the even distribution.

Figure 3D:
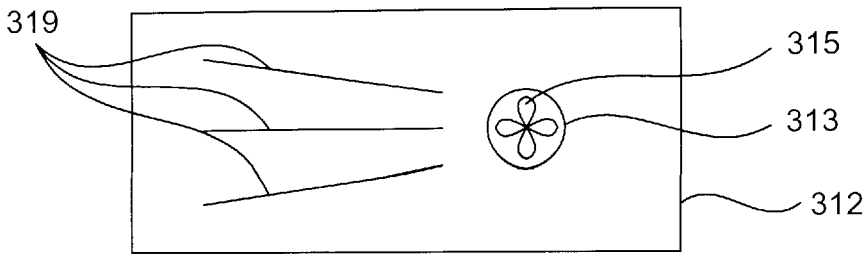
FIG. 3D depicts a cross-sectional top view of the air plenum of FIG. 3B showing air guides in accordance with a preferred embodiment of the present invention.

In the top plenum 312, the longer the distance between the center of the fan 315 and the turn from the horizontal to the vertical portion of the plenum, the better the distribution becomes. Additionally, guides may be incorporated into the plenum to ensure that the flow reaches both ends of the supply air outlets. In a preferred embodiment illustrated in a cross-sectional top view of the air plenum 312 in FIG. 3D, 3 such guides 319 are shown.

It should be noted that in the preferred embodiment of the present invention described herein, many measures are taken to achieve optimal flow distribution, without increasing the pressure drop of the outlets. However, these measures are not necessary, and could or least be relaxed in hood designs where significant pressure drop (which costs fan power—and fan energy) occurs. That is, implementation of the aspect of the invention that supplies air at the face of a fume hood to create a barrier, without optimizing the energy savings from such implementation is still within the scope of the present invention. This is further illustrated by the examples, below, where the initial design mock-up to test the concept of the present invention (example 1) had a pressure drop at the supply air outlets of about 150 Pa, whereas the pressure drop at the supply air outlets of the refined mock-up (example 2) was only about 2.2 Pa. Moreover, such measures may not be necessary to achieve substantial energy saving in all implementations.

In the preferred embodiment of the invention illustrated in FIG. 3A, the bottom work area panel 308 also contains a supply air plenum 320 which supplies ambient room air through a supply air inlet 321 equipped with a fan 323, to an supply air outlet 322 located at the bottom of the open face 310, using a configuration similar to that described for the top 304 and front 309 enclosure panels. As noted above, while the air supplied to the supply air sources (outlets) 314 and 322 in this embodiment comes from ambient room air, alternative embodiments in accordance with the present invention may provide, for example, an auxiliary air supply to the supply air sources 314 and 322.

The hood 300 of the preferred embodiment of FIG. 3A is also equipped with a back baffle 330 connected at its lower end to a lower portion of the back enclosure panel 306, running upwards about parallel to the back enclosure panel 306 and angling towards the front of the hood 300 to connect with the top enclosure panel 304. The baffle 330 provides a porous barrier through which air in the work chamber 302 must pass to exit the work chamber through an exhaust outlet 340 provided at the top rear of the hood 300. Rather than containing slots, the back baffle 330 is perforated with holes, for example, about 0.25 inches in diameter, distributed in a pattern designed to achieve optimal containment. In the preferred embodiment of FIG. 3A, the back baffle is about 4 feet wide by about 60 inches high. About 70% of the holes are in the perimeter region of the bottom and sides of the baffle (within about 12 inches of sides and bottom), with about a second concentration of holes (about 10% of the total) in an area about 1 foot wide and running the whole height of the baffle 330. The remaining holes are distributed fairly evenly over the remainder of the baffle 330.

In a preferred embodiment of the present invention, the portion of the supply air plenum 312 in the partial front enclosure panel 309 may be about 7 inches in depth and extends across the whole width of the front of the hood 300. The supply air outlet 314 in this partial front enclosure portion 309 may be approximately equally divided by a sash housing 317, which effectively separates the air outlet 314 into two air outlets on either side of the sash 316. While the sash in this embodiment is a vertically-opening sash, other types of sashes, for example, horizontally-opening sashes, may also be used. The breadth of the supply air plenum 312 in the top enclosure panel 304 is about 2.5 inches in this preferred embodiment. The breadth of the supply air plenum 320 in the bottom work area panel 308 is also about 2.5 inches in this embodiment. The supply air outlet 322 at the lower edge of the face 310 in this embodiment is about 3.5 inches in depth. The supply air inlets 313 and 321 are both preferably about 6 inches in diameter.

The dimensions provided for this preferred embodiment are intended for a fume hood which is about 5 feet wide (exterior dimension) with about 6 inch side walls, and having a sash opening of approximately 28 inches in height by 40 inches in width, and an interior height of about 48 inches. It should be understood that fume hoods in accordance with the present invention may be designed to have whatever dimensions are required for an intended application, and therefore the invention is in no way limited to the dimensions provided in this preferred embodiment.

The arrows in FIG. 3A depict the direction of air flow into, through, and out of the fume hood 300 in accordance with the present invention. Air enters the work chamber of 302 of the fume hood 300 through both the supply air outlets 314 and 322 at an angle about parallel with the open face 310, as shown by arrows 352 and 354. Air also enters the work chamber 302 directly through the open face 310 at an angle about perpendicular to the open face 310 from the laboratory room, as shown by arrows 356. Once inside the work chamber 302, the air is drawn more or less uniformly to and through the perforated baffle 330, as shown by arrows 358. Once the air is passed through the baffle 330 it is exhausted through the exhaust outlet 340 as shown by arrows 360.

In accordance with a preferred embodiment of the present invention, the air flow provided through the supply air outlets 314 and 322 has low turbulence intensity, for example, about 10%, that is, about 10% change in air flow velocity over time versus the average air flow velocity. It should be noted that the air flow may be provided through the supply air outlets 314 and 322 over a range of turbulence intensities, for example, from about 0% to 100%. The lower the turbulence of the air flow emitted by the supply air outlets at the face, the lesser the mixing with air on either side of the air flow, and the deeper the core of the air flow which has its original velocity and is not being mixed with surrounding air. The core of the air flow provides an effective barrier to the air in the work chamber 302. In one preferred embodiment, air is emitted from the supply air outlets with a core air flow velocity of approximately 100 fpm (about 0.5 m/s). The air exhausted from the fume hood may be as low as 25% of that exhausted from a conventional fume hood with a typical face velocity of 100 fpm, resulting in substantial energy savings due to reduced air conditioning requirements. In a preferred embodiment, a large portion, for example 75–90%, of the air entering the work chamber 302 is supplied through the supply air outlets 314 and 322, with the remaining air coming directly through the face 310. This division of air supply flow is achieved in the preferred embodiment by providing air through the supply air outlets at a flow of about 100 fpm.

In a preferred embodiment of the present invention, shown in FIG. 3A, air is supplied from supply air outlets 314 and 322 at both the top and bottom of the open face 310 of the hood, respectively, with the supply air outlets located on both sides of the sash 316. It should be noted that it may also be possible to have supply air outlets (or a single outlet) located in other positions in the face, as long as it/they are capable of producing an air barrier between air on either side of the air flow provided by the outlet(s) in the face.

The supply air outlets 314 and 322 are preferably covered with a porous material 325 which allows approximately uniform passage of air through the outlets. In a preferred embodiment, a uniform wire mesh (for example: 100×100 mesh per inch, standard grade stainless steel, wire diameter 0.0045 inches, open surface 30.3%) material is used. The porous material should be selected to stand up to the rigors of normal hood operation, and may be composed of, for example a fabric, metal or alloy. For optimal energy efficiency, the use of a particular porous material is preferably coordinated with the speed of the air supply fans to achieve sufficient flow with minimal pressure drop at the supply outlets.

As noted above, the turbulence intensity of the air flow supplied at the face of the hood determines the amount of mixing of the supply air with the air on both sides of the air flow (room air on one side, work chamber air on the other side). The air flow has a core zone (which becomes smaller with distance from the outlet) with the original supply outlet velocity, and a mixing zone around the core zone. The core zone will see no or only little mixing with the surrounding air. Generally, the supply air outlet is preferably designed so that the core zone is wide enough to protect the face of the hood, particularly against contaminated air in the work zone which might be directed towards the face.

Since an important feature of the present invention is energy efficiency achievable with a low-flow fume hood, it is preferable to maximize the air flow supplied to the work chamber 302 via the supply air outlets at the top and bottom of the face, consistent with safe and effective operation of the fume hood. As noted above, in a preferred embodiment of the present invention, about 90% of the air entering the work chamber 302 is provided through the supply air outlets. However, the present invention also contemplates the situation where greater or less than about 90% of the air entering the work chamber 302 is supplied through supply air outlets in the hood's face (for example, about 75% or 50%). Moreover, while the supply air outlets 314 and 322 in the preferred embodiment illustrated in FIG. 3A have a flat profile perpendicular to the open face 310 of the fume hood 300, other profiles for supply air outlets consistent with the provision of a low turbulence intensity protective layer of air between air on either side of the face may also be used.

Low-flow fume hoods in accordance with the present invention may reduce a laboratory's energy consumption and peak-power requirements for fan and make-up air conditioning energy. Because of this reduced make-up air requirement, air conditioning equipment may be downsized, which reduces initial equipment costs and space requirements for the air handler and the duct work of a laboratory facility. Since a large portion of the air to be exhausted is supplied in the face of the fume hood, a person standing in front of the hood has a minimal influence on flow through the face. Therefore, the danger of reversed flow is substantially reduced with a low-flow fume hood in accordance with the present invention.

Moreover, since air supplied to a low-flow fume hood in accordance with the present invention may be taken directly from laboratory ambient air, there is no need to have an additional air handling system, as is required with auxiliary air fume hoods. Also, because the amount of air exhausted by the hood is so much less than with conventional fume hoods, an expensive and complex VAV-system is unnecessary.

In addition, because of the two-fan position arrangement of the preferred embodiment of the present invention described with relation to FIG. 3A (one set of fans in the air plenums directing air into the work chamber through supply air outlets, and another fan in the exhaust duct) low-flow fume hoods in accordance with preferred embodiments of the present invention are safer in case of an equipment failure. Embodiments of the present invention may also be equipped with a warning device to signal if a pressure drop decrease is detected due to fan failure.

Finally, powdery substances used inside conventional fume hoods are often lost in part as turbulent air flows suck powder off the work area and directly into the exhaust. The reduced turbulence air flows in the work chamber of a low-flow fume hood in accordance with the present invention have such small velocities that there is no imminent danger of powder chemicals becoming airborne.

Example 1—Test of Concept

In order to test the concept of the present invention, a mock-up of a low-flow fume hood was constructed. A frame made of rectangular PVC pipe was built to enclose the face of a conventional fume hood. The frame was cut open toward the center of the face. The open areas were covered with fabric that allowed air to flow at low velocity and low turbulence intensity toward the center of the fume hood face. At the air outlet, air flow was perpendicular to the flow found in conventional hoods. The supply air was taken from the laboratory itself; no auxiliary air flow was used. The air emitted from the outlets built a protected buffer zone between the volume of the hood and the laboratory space, as described further below.

The exhaust air flow in the mock-up could be modified by a damper placed in the exhaust duct above the hood. The fan on the roof of the building in which the fume hood was installed exhausted only air from this hood. Before the frame was inserted, the open face of the hood with the sash fully elevated was about 0.9 meters wide and about 0.70 meters high. The rectangular PVC pipe from which the frame was constructed had a square cross-section of 63 millimeters on a side. The cutaway section toward the center of the face was 50 millimeters wide and covered with a fabric mesh as described above.

Because the frame was not fully integrated into the hood design, air was supplied to the frame by flexible duct at two points only, the lower left corner and the upper right corner of the frame. This arrangement caused high turbulence within the pipes forming the frame. Consequently, some uneven air velocities were observed at the supply air outlets surfaces.

The design exhaust air flow for the conventional hood, with a face opening reduced by the frame, at 100 fpm (0.5 m/s) is 994 $m^3$/h. For the tests in this example, the exhaust air flow was reduced to approximately 33% of the design air flow for the conventional hood. The pressure drop at the supply air outlets was about 150 Pa.

For flow visualization an ultrasonic humidifier was used. The humidifier produced fog and ejected it at low velocity into the hood.

Figure 4:
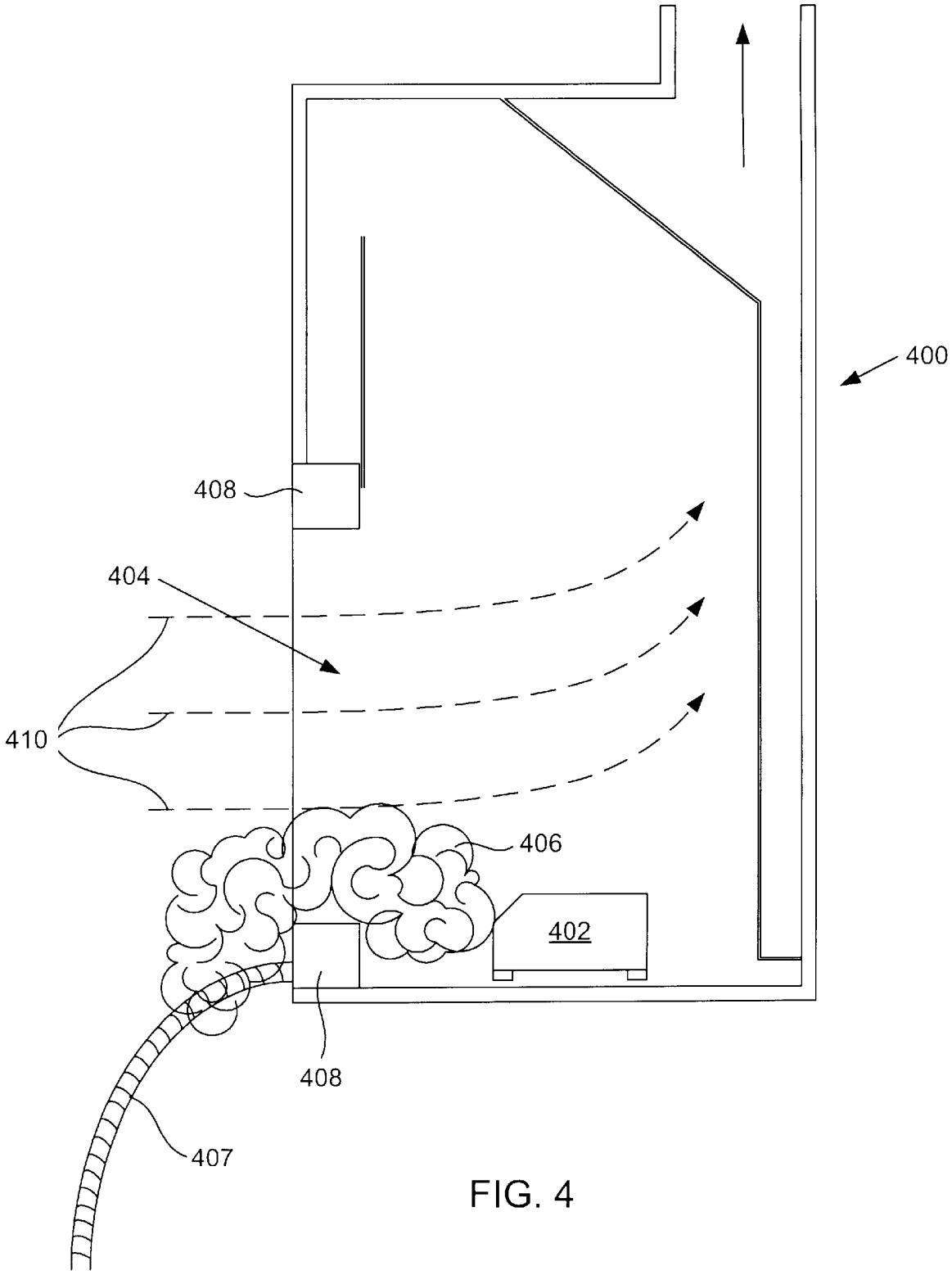
FIG. 4 is a cross-sectional side view of a mock-up of a low-flow fume hood in accordance with the present invention illustrating containment of a vapor generated in the hood without air being supplied at the face.

FIG. 4 shows the flow visualization result for the reduced exhaust air flow without additional air supply from the frame 408 (air was supplied to the frame by flexible ducting 407). The humidifier 402 in the hood 400 directed the fog supply toward the open face 404. Because the cool fog 406 has a higher density than air, spills can be observed escaping at the bottom of the hood 400. Broken arrows 410 represent air entering the hood through the open face 404.

Figure 5:
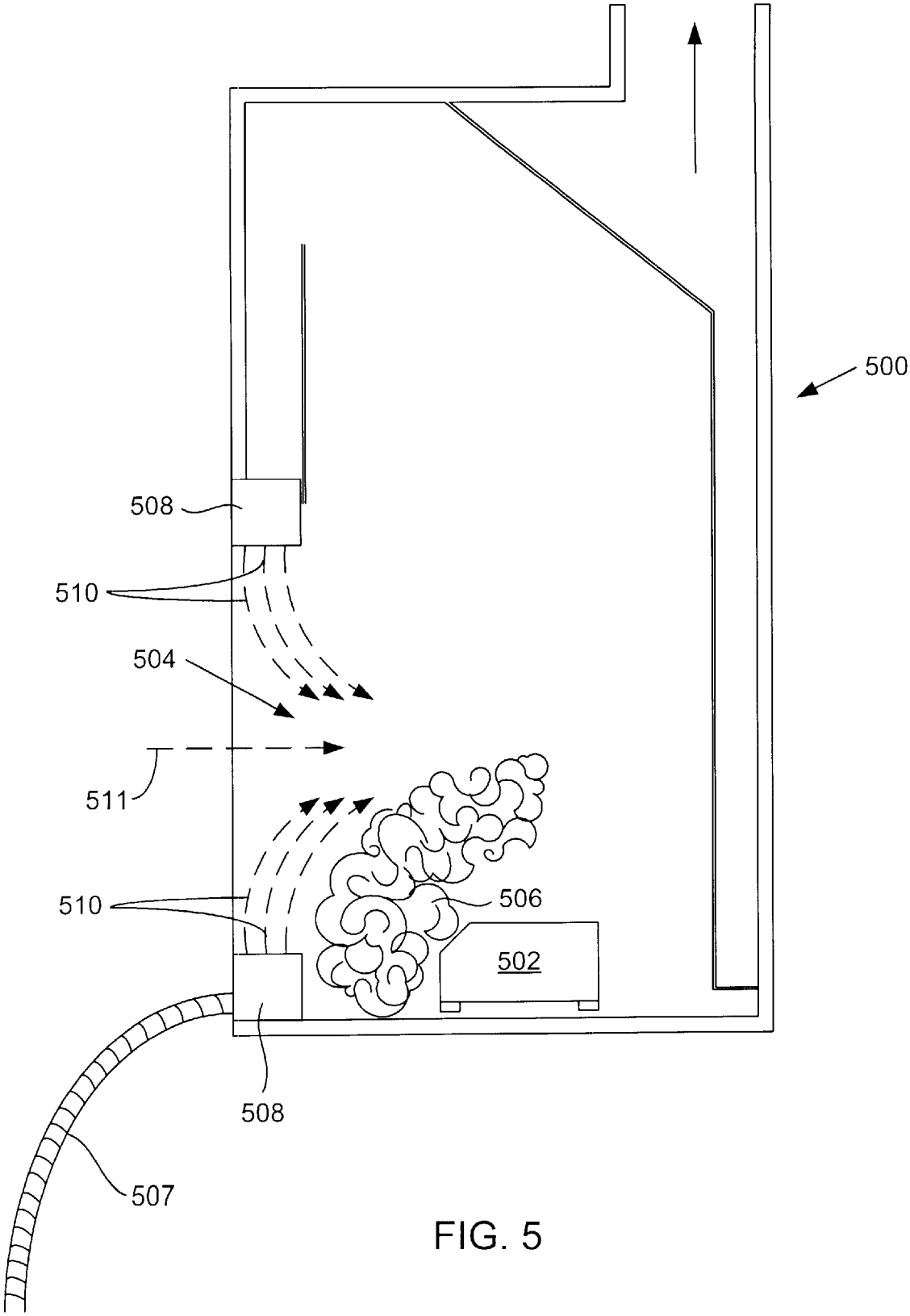
FIG. 5 is a cross-sectional side view of a mock-up of a low-flow fume hood in accordance with the preferred embodiment of the present invention showing containment of a vapor generated in the hood when air is supplied at the face.

FIG. 5 shows the flow visualization when approximately half of the exhaust air, is supplied by the frame. The humidifier 502 sits in the hood 500 and again emits a fog supply directed toward the open face 504. The cool fog 506 initially moves down and toward the bottom of the open face 504, but then encounters the barrier formed by the low turbulence intensity air supplied by the air outlets in the frame 508 (air was supplied to the frame by flexible ducting 507). The air flow supplied by the outlets in the frame is represented by broken arrows 510. The reduced amount of air entering the hood through the open face 504 is represented by broken arrow 511. As the fog 506 moves towards the lower air outlet of the frame 508 in the face of the hood, it is effectively displaced by the supply air, and no fog spills are visible.

This experiment shows that a fume hood can contain contaminants even with low exhaust air flows if an air buffer is created in the face of the hood. The limited amount of low turbulence air supplied by the make-up frame in this mock low-flow fume hood mainly protected the critical locations of the fume hood, mainly the edges of the face. It should be expected that higher supply air flows from the frame would further reduce air flows and protect the entire hood area.

Example 2—Test of Refined Low-Flow Fume Hood Design

ASHRAE 110 TRACER GAS TEST REPORT

Description of Fume Hood

Experimental proprietary design (as described with reference to FIGS. 3A–3D): Low-flow fume hood with supply air from top and bottom edges of face perimeter.

Hood is of simple construction, not highly aerodynamic, and intended to test concept.

Sash full open at 29"; face width: 48".

Description of Test Procedure

Basic tracer gas test without sash movement effects.

No face velocity tests performed due to low face velocities of design.

Dry ice procedure of ASHRAE 110 Appendix used and videotaped.

Acceptability Level 0.1 ppm or less for 5 minute average at all 3 mannequin positions, based on ANSI/AIHA Standard Z9.5 (1992), Section 5.7. The As-Installed or As-Used designation is appropriate for this case since the room conditions were not carefully controlled as would occur at a hood manufacturer laboratory.

Deviations (if any) from ASHRAE 110 Procedure

Horizontal distance from sash to center of probe was 4.5 inches rather than 3 inches due to hood design of upper face area. Mannequin forehead was against hood and could not be moved forward more.

Results Description

Table 1, summarizes test plan and results, indicating the mannequin positions, run number, average and maximum tracer concentrations, and a Pass/Fail designation. The runs are grouped to show the effects of various parameters.

The fume hood passed the ASHRAE 110 test with the initial setup configuration: Exhaust flow setting of 72 Pa and supply flow settings of 2.2 Pa and 2.3 Pa for the upper and lower supply vents. Exhaust and supply flows set by designer. The three mannequin positions are at the center, and 12 inches (centered) from the left and right inside walls of the hood. A scan of the edge or perimeter of the hood face was performed for the initial setup (denoted "Edge" in the Table 1) with the detector probe hand-held and the mannequin removed. This setup was retested several times as indicated in Table 1.

TABLE 1

Summary of Results
ASHRAE 110 Tracer Gas Tests
BASIC TESTS: exhaust = 72 Pa; Supply upper = 2.3 Pa, lower = 2.2 Pa

| Run | Mannequin/ Position | Pass/ Fail | Ave. ppm | Max ppm | Comments |
|---|---|---|---|---|---|
| 100 | Center | PASS | 0.001 | 0.013 | |
| 101 | Center | PASS | 0.015 | 0.166 | door open |
| 101 | Right | PASS | 0.000 | 0.003 | |
| 101 | Left | PASS | 0.027 | 0.146 | |
| 101 | Edge | PASS | 0.007 | 0.013 | |
| 106 | Left | PASS | 0.070 | 0.219 | repeat |
| 114 | Right | PASS | 0.009 | 0.027 | door closed; 3 minute test |

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A fume hood, comprising:

a partially enclosed work chamber having a front open face;

top and bottom supply air sources at the face of said work chamber, each of said supply air sources including a substantially flat, porous surface portion about perpendicular with said open face for distributing supply air substantially parallel to the open face;

at least one air exhaust outlet from said work chamber; and wherein supply air emitted through said top and bottom supply air sources to said face provides a protective layer of air between air on either side of said face and said supply air emitted through said supply air sources to said face has a low turbulence intensity.

2. A fume hood according to claim 1, wherein said supply air has a turbulence intensity of from about 0 to 10%.

3. A fume hood according to claim 1, wherein said supply air has a turbulence intensity of about 10%.

4. A fume hood according to claim 1, wherein said work chamber further comprises a back baffle perforated with holes separating said work chamber from said air exhaust outlet.

5. A fume hood according to claim 4, wherein about 70% of said holes are located in a bottom and side perimeter region of said back baffle.

6. A fume hood according to claim 5, wherein said back baffle runs upwards about parallel to the back enclosure panel and angles towards the front of the hood to connect with the top enclosure panel.

7. A fume hood according to claim 1, wherein each of said top and bottom supply air sources each has a flat profile about perpendicular with said open face.

8. A fume hood according to claim 6, wherein said baffle is connected with top and back panels partially enclosing said work chamber.

9. A fume hood according to claim 1, wherein air is emitted from said top and bottom supply air sources at a velocity of about 100 feet per minute.

10. A fume hood according to claim 1, wherein air emitted from said top and bottom supply air sources at said face comprises between about 50 and about 90% of air exhausted from said work chamber.

11. A fume hood according to claim 1, wherein air emitted from said top and bottom supply air sources at said face comprises between about 75 and about 90% of air exhausted from said work chamber.

12. A fume hood according to claim 1, wherein air emitted from said top and bottom supply air sources at said face comprises about 90% of air exhausted from said work chamber.

13. A fume hood according to claim 1, wherein air emitted from said top and bottom supply sources includes air obtained from ambient room air surrounding said hood.

14. A fume hood according to claim 1, wherein air emitted from said top and bottom supply sources is obtained from ambient room air surrounding said hood.

15. A fume hood according to claim 1, wherein air emitted from said top and bottom supply sources includes air obtained from an auxiliary air source.

16. A fume hood according to claim 1, wherein said top and bottom supply sources create a pressure drop of about 2 Pa.

17. A fume hood according to claim 1, wherein said top and bottom supply sources are covered with a mesh material.

18. A fume hood according to claim 17, wherein said mesh material is a wire mesh.

19. A fume hood according to claim 18, wherein said wire mesh has a mesh size of about 100×100 per inch and an open surface of about 30%.

20. A fume hood according to claim 1, wherein air is provided to said top and bottom supply sources through one or more supply air plenums.

21. A fume hood according to claim 20, wherein air is provided to each of said supply air plenums by a fan.

22. A fume hood according to claim 21, wherein air provided to said top and bottom supply air plenums is pushed through one or more flow straighteners.

23. A fume hood according to claim 22, wherein said top and bottom supply air plenums contain one or more air distribution guides.

24. A fume hood according to claim 16, wherein air exhausted from said hood is less than about 50% of that exhausted from the hood when no air is emitted from said top and bottom supply air sources and air enters the hood at a velocity of about 100 feet per minute.

25. A fume hood according to claim 16, wherein air exhausted from said hood is about 25% of that exhausted from the hood when no air is emitted from said top and bottom supply air sources and air enters the hood at a velocity of about 100 feet per minute.

26. A method of preventing airborne contaminants from escaping through the face of a fume hood, comprising:

supplying an air flow from top and bottom air sources at the face of the fume hood, each of said supply air sources including a substantially flat porous surface portion about perpendicular with said face to produce a protective layer of air between air on either side of said face wherein said air flow has a low turbulence intensity and substantially reduces the air exhausted from the fume hood.

27. A fume hood according to claim 26, wherein the air supplied to said face has a turbulence intensity of about 0 to 10%.

28. A fume hood according to claim 26, wherein the air supplied to said face has a turbulence intensity of about 10%.

29. A method according to claim 26, wherein the air is supplied to the face of the fume hood through top and bottom supply air sources at the face of said hood, each of said supply air sources including a substantially flat surface portion about perpendicular with said open face, and air is exhausted from said fume hood through at least one air exhaust outlet from said hood.

30. A method according to claim 26, wherein air emitted from said supply air sources at said face comprises between about 50 and about 90% of air exhausted from said hood.

31. A method according to claim 30, wherein air emitted from said supply sources includes air obtained from ambient room air surrounding said hood.

32. A method according to claim 26, wherein supplying said air flow from said top and bottom supply air sources is a velocity of about 100 feet per minute.

33. A method according to claim 26, wherein supplying said air flow from said top and bottom supply air sources creates a pressure drop of less than about 2 Pa.

34. A fume hood, comprising:

a partially enclosed work chamber having a front open face;

top and bottom supply air sources at the face of said work chamber, each of said supply air sources including a substantially flat, porous surface portion about perpendicular with said open face for distributing supply air substantially to the open face; and at least one air exhaust outlet from said work chamber.

* * * * *